US012478119B1

(12) United States Patent
Kobinsky

(10) Patent No.: US 12,478,119 B1
(45) Date of Patent: Nov. 25, 2025

(54) ANKLE PROTECTOR

(71) Applicant: 1LIFEONEARTH LLC, Cross Plains, WI (US)

(72) Inventor: Kevin Kobinsky, Middleton, WI (US)

(73) Assignee: 1LIFEONEARTH LLC, Cross Plains, WI (US)

( * ) Notice: Subject to any disclaimer, the term of this patent is extended or adjusted under 35 U.S.C. 154(b) by 0 days.

(21) Appl. No.: 18/824,306

(22) Filed: Sep. 4, 2024

(51) Int. Cl.
*A41D 13/06* (2006.01)
*A41B 11/02* (2006.01)

(52) U.S. Cl.
CPC ..... *A41D 13/06* (2013.01); *A41B 11/02* (2013.01)

(58) Field of Classification Search
CPC ..... A41B 11/006; A41B 11/02; A41D 13/06; A63B 2071/1275; A63B 71/1225; A61F 13/066; A61F 5/0111
See application file for complete search history.

(56) References Cited

U.S. PATENT DOCUMENTS 4,590,932 A * 5/1986 Wilkerson ..... A61F 5/0111 602/65
4,719,926 A 1/1988 Nelson
5,185,000 A * 2/1993 Brandt ..... D04B 1/18 602/65
5,823,195 A * 10/1998 Shook ..... A61F 5/30 128/893
6,018,892 A 2/2000 Acheson et al.
6,442,875 B1 * 9/2002 Joubert ..... A43B 7/20 36/117.6
11,839,570 B1 * 12/2023 Solotoff ..... A61F 13/08
2004/0158283 A1 * 8/2004 Shook ..... A61F 5/34 601/151
2011/0119808 A1 * 5/2011 Sherman ..... A61F 5/0111 36/71
2014/0053320 A1 2/2014 Hasan et al.
(Continued)

FOREIGN PATENT DOCUMENTS

GB 2309168 A * 7/1997 ..... A61F 5/0111

OTHER PUBLICATIONS

1Lifeonearth. "Ice Skate Ankle Pads, Cushioned/Padded Ankle Sleeves used to reduce ankle pain during Ice Skating and Hockey (PAIR)." Sep. 18, 2023. Retrieved from Internet: <https://www.amazon.com/1Lifeonearth-Cushioned-Padded-Sleeves-Skating/dp/B0C9CBHVYV> (Year: 2023).*
(Continued)

*Primary Examiner* — Aiying Zhao
(74) *Attorney, Agent, or Firm* — Stiennon & Stiennon

(57) ABSTRACT

An ankle protector garment for surrounding the ankle of a wearer of a boot has a resilient woven toeless tubular body extending from an upper cuff to a lower cuff. Pockets on either side of the body receive foam pads. Each pad has an upper segment with downwardly extending forward and rear tabs which are spaced on either side of a gap, with the rear tab being shorter than the forward tab. The body positions the tabs of each pad about the lateral and medial malleolus of a wearer, to thereby lessen the bearing of the boot on the protruding portions of a wearer's ankle. The gap is open downwardly, accommodating a range of wearer malleolus positions. The pads further extend above the upper margin of the boot to alleviate the bearing of the boot on the wearer's lower leg.

20 Claims, 2 Drawing Sheets

(56) References Cited

U.S. PATENT DOCUMENTS

| | | | | |
|---|---|---|---|---|
| 2014/0259260 | A1* | 9/2014 | Behrend | A63B 71/1225 2/22 |
| 2017/0056233 | A1* | 3/2017 | Kelly | A61F 5/0111 |
| 2018/0168840 | A1* | 6/2018 | Fontaine | B29C 51/421 |
| 2020/0222784 | A1* | 7/2020 | Yang | A63B 71/1225 |
| 2020/0260801 | A1* | 8/2020 | Dooley | A41B 11/02 |

OTHER PUBLICATIONS https://www.amazon.com/CRS-Cross-Malleolar-Gel-Sleeves/dp/B078QXDX87 "CRS Cross Ankle Malleolar Gel Sleeves—Padded Skate Sock with Ankle Bone Pads for Figure Skating, Hockey, Inline, Roller, Ski, Hiking or Riding Boots. Ankle protector cushion. (One Size Fits Most)," CRS Cross, screen shot of webpage, downloaded Sep. 4, 2024.

https://www.amazon.com/CRS-Cross-Boot-Bumper-Sleeve/dp/B07L1C4FVG "CRS Cross Boot Bumper Gel Pad Sleeve—Padded Skate Sock for Foot Protection of Achilles Tendon (Heel) and Lace Bite (Front of Foot). Skating, Hockey, Roller, Ski, Hiking (X-Large)," CRS Cross, screen shot of webpage, downloaded Sep. 4, 2024.

* cited by examiner

ANKLE PROTECTOR

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to protective garments generally, and more particularly to those which decrease discomfort in wearing boots such as ice skate boots.

The human leg has two vertically extending bones. The tibia is positioned on the inner or medial side of the leg, and the fibula is positioned on the outer or lateral side of the leg. The tibia terminates in a protuberance known as the medial malleolus, and the fibula terminates in a protuberance known as the lateral malleolus. Because the medial and lateral malleolus protrude outwardly, they are disposed to rub against a surrounding boot which extends above the ankle, such as is found on an ice skate or a roller skate, such that extended use of such footwear can be a source of discomfort.

It is known to incorporate padding into the skate boot to shelter the medial and lateral malleolus, but such padding is secured to the boot, thereby complicating laundering or replacement. Moreover, as an integral portion of the boot, such padding does not rise above the boot tops, and leaves the wearer exposed to discomfort at the interface between the wearer's calves and the boot top. In addition, the anatomy of each person varies. Some people even have additional bones or bone structures that can protrude and cause discomfort if engaged directly with the boot.

Loose insertable braces are readily serviced separate from the boot, but are prone to displacement from their position about the wearer's ankles. Ankle pads worn as an element of a sock or toeless-sock garment are know which place a pad directly over the malleolus, but these too can exert pressure on protruding portions of the ankle in an uncomfortable manner.

What is needed is an arrangement for avoiding discomfort to a wearer of a boot which is separable from the boot itself, is readily secured to the wearer and which can accommodate a range of wearer anatomy in the region of the ankle.

SUMMARY OF THE INVENTION

The ankle protector of this invention has the form generally of a toeless sock and supports foam pads on the wearer's ankles to reduce the bearing of the surrounding boot, for example of an ice skate, on the protruding lateral and medial malleolus of the wearer. The garment has a resilient woven toeless tubular body extending from an upper cuff to a lower cuff. Two pads, each a mirror image of the other, are received in pockets defined between inside and outside panels of the body. Each pad has an upper segment positioned to cushion the engagement of the wearer's lower leg with the upper margin of the boot and downwardly extending forward and rear tabs. The tabs are spaced on either side of a gap, with the rear tab being shorter than the forward tab. The tubular body positions the tabs of each pad about the lateral and medial malleolus of a wearer, to thereby lessen the bearing of the boot on the protruding portions of a wearer's ankle. The tabs are separated by a downwardly opening gap which accommodates a range of wearer anatomy.

It is an object of the present invention to provide a garment which alleviates discomfort when wearing a boot.

It is another object of the present invention to provide an ankle protector in which a single garment may be worn effectively by wearers of differing anatomy.

It is a further object of the present invention to provide an ankle protector which also reduces the discomfort of engaging the wearer's lower leg against the upper margin of a boot.

Further objects, features and advantages of the invention will be apparent from the following detailed description when taken in conjunction with the accompanying drawings.

DESCRIPTION OF THE PREFERRED EMBODIMENTS

Figure 3:
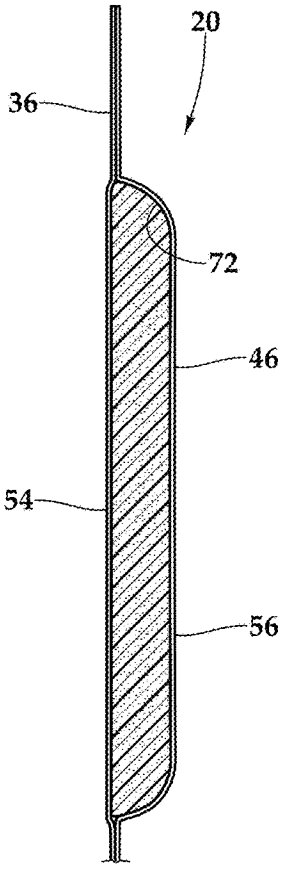
FIG. 3 is a cross-sectional view of the ankle protector of FIG. 1, taken along section line 3-3.
Figure 1:
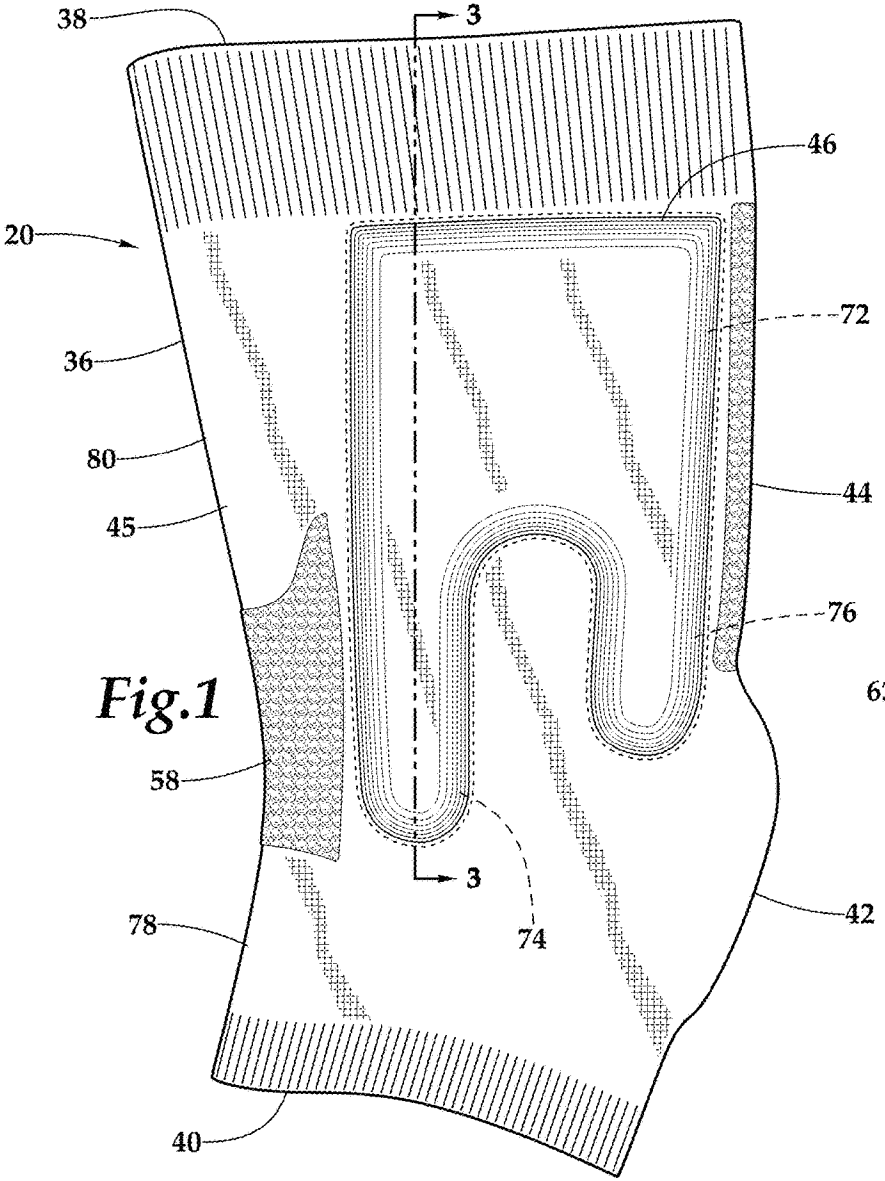
FIG. 1 is a side elevational view of the ankle protector of this invention in a relaxed configuration.
Figure 5:
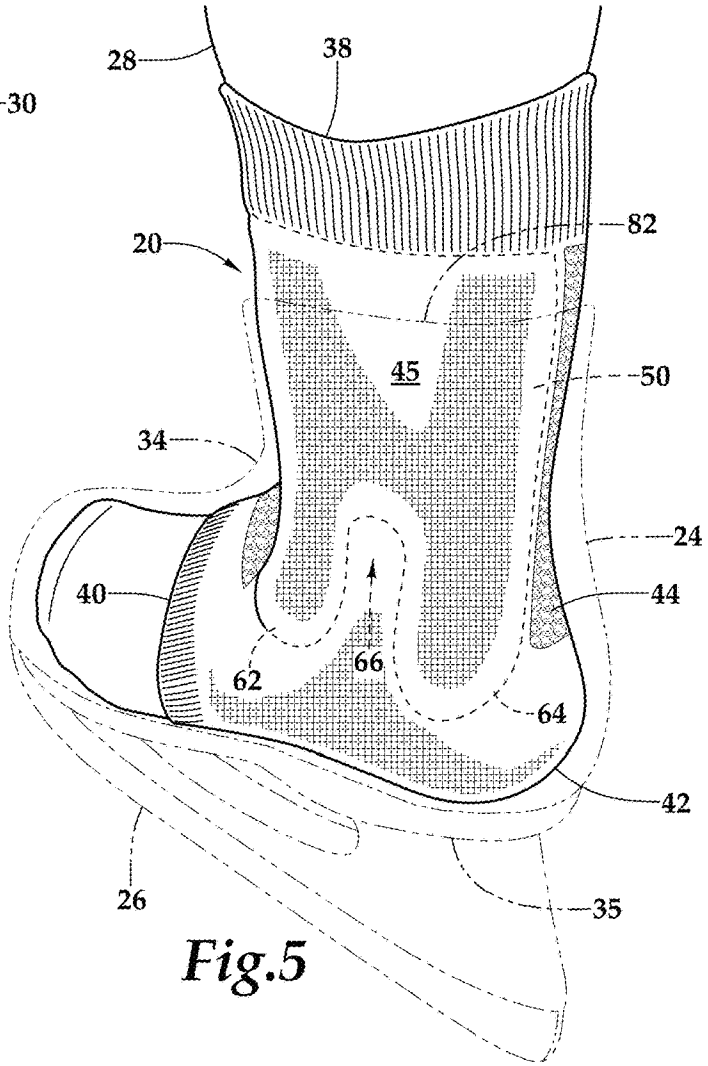
FIG. 5 is a perspective view of the ankle protector of FIG. 1 mounted on the human foot of FIG. 4 and disposed within an ice skate, shown in phantom view.
Figure 4:
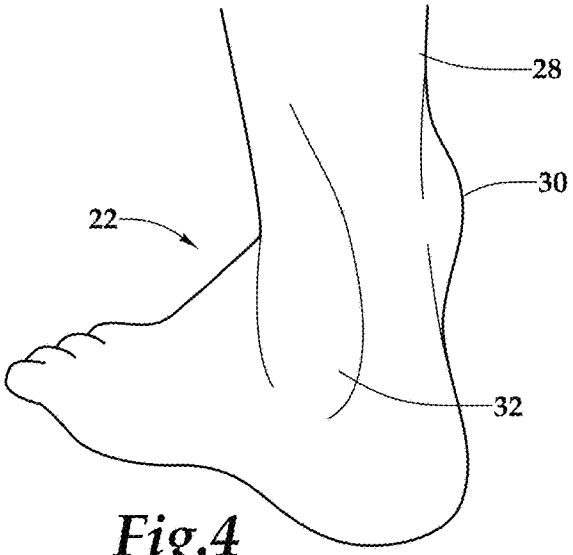
FIG. 4 is a perspective view of a human lower leg and foot.

Referring more particularly to FIGS. 1-6, wherein like numbers refer to similar parts, an ankle protector 20 is shown in FIG. 1 which is configured to be worn on a human foot 22 such as is shown in FIG. 4 for improved comfort while wearing a boot 24, for example one with a sole 35 with an attached skate blade 26 which serves as an ice skate, as shown in FIG. 5.

A lower portion of a wearer's left leg is shown in FIG. 4, having two vertically extending bones, the tibia on the inner or medial side of the leg (on the right in FIG. 4), and the fibula positioned on the outer or lateral side of the leg (on the left in FIG. 4). The tibia terminates in the protuberance of the medial malleolus 30, and the fibula terminates in the protuberance of the lateral malleolus 32. Both the medial malleolus 30 and the lateral malleolus 32 are disposed very close to the body's exterior beneath the skin. These protuberances can rub against the surrounding boot 24 and cause the wearer discomfort. The ankle protector 20 relieves discomfort not by applying cushioning to overlie the central portions of the malleolus, but by surrounding the central portions of the malleolus with padding which reduces the impact of the walls of the boot upper 34 in engaging with the malleolus. In addition, the navicular bone is positioned beneath the medial malleolus, and can protrude more or less in this area. As discussed below, some people have a condition known as accessory navicular syndrome, in which an additional piece of cartilage or bone protrudes beneath the medial malleolus. In wearers with a particularly protuberant navicular bone, or having accessory navicular syndrome, these areas can be a region of discomfort when engaged with a boot.

The ankle protector 20, as shown in FIG. 1, has a woven fabric tubular body 36 which is resilient and stretchable to conform to the shape of a particular wearer's foot. The tubular body 36 may be woven of nylon and spandex. The body 36 extends from an upper cuff 38 which will be disposed above the wearer's ankle, to a lower cuff 40 beyond a heel 42. The tubular body is curved to extend forwardly at the heel 42. The lower cuff 40 is open frontwardly making the ankle protector 20 toeless. The tubular body 36 may be assembled from a sheet which is folded and sewn at a seam 44 at the rear of the body passing through the heel 42. The tubular body 36 has a first side 45 and an opposite second side 47 each of which are formed from two layers to define pockets 46, 48 which receive molded pads 50, 52. As shown in FIG. 3, each pocket has an inside panel 54 which contacts the wearer, and an outside panel 56 which faces the boot 24. The tubular body 36 may be fabricated with a stretchy expandable stretch panel 58 at the front between the two pockets 46, 48, which accommodates a variety of size of user. To facilitate the escape of moisture through the ankle protector 20, perforated segments 78, 80 with an array of small openings about 1 mm in diameter may be formed above and below the stretch panel 58.

Figure 2:
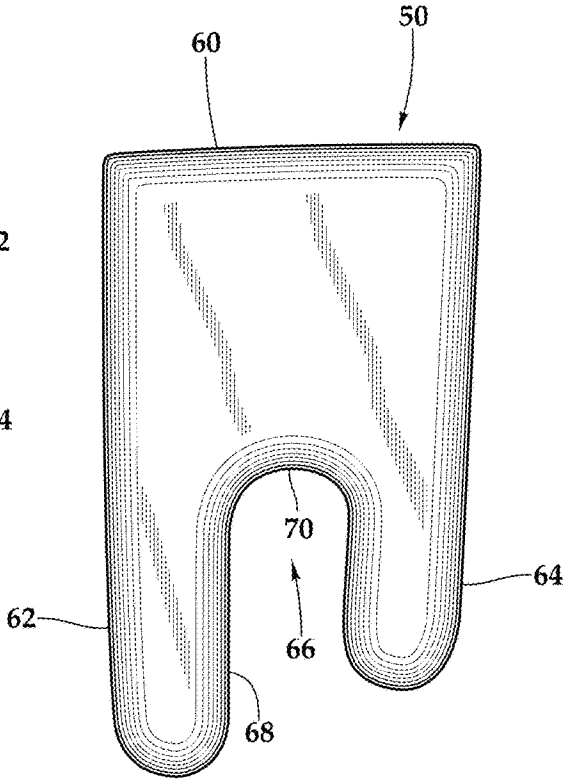
FIG. 2 is a side view of one of the two ankle pads of the ankle protector of FIG. 1, the other ankle pad is a mirror image of the one shown.

The pads 50, 52 are formed of a cushioning material, such as molded ethylene-vinyl acetate copolymer (EVA) closed cell foam, which may be about ⅜ to ¾ inches thick. The pads 50, 52 are of similar shape, but are mirror images of one another. As shown in FIG. 2, the first pad 50 has an upper segment 60 which may be about 9 cm wide. A forward tab 62 and a rear tab 64 extend downwardly on either side of a gap 66. The lower end of each tab 62, 64 preferably is rounded. Each pad has a lower edge or margin 68 which defines the gap 66, The pad gap 66 is downwardly concave and which has an apex 70 which is closest to the top of the pad. The forward tab 64, closer to the wearer's toes, is longer than the rear tab 64. The distance the rear tab 64 extends beneath the gap apex 70 may be more than half the distance which the forward tab extends, and less than three quarters of that distance. For example, the forward tab 62 may extend about 7.5 cm beneath the apex, and the rear tab 64 may extend about 5.5 cm. In the front to back direction, each tab may have a width of about 2.6 cm. The width of the gap between the forward tab and the rear tab is at least as great as the width of the forward tab, for example, the rear tab may be spaced about 3.8 cm rearwardly of the forward tab 62.

Each pad 50, 52 is fixed within a pocket 46, 48, for example by being inserted within the pocket and then sewing an upper margin of the pocket closed. Thus the pads are intimately associated with the tubular body 36 and do not shift with respect to it in use. Each pocket defines an interior which mates with the particular shape of the pads: each pocket has an upper region 72 with a downwardly extending forward cavity 74 spaced away from the heel and a rear cavity 76 positioned between the heel and the forward cavity, and spaced from the forward cavity.

Figure 6:
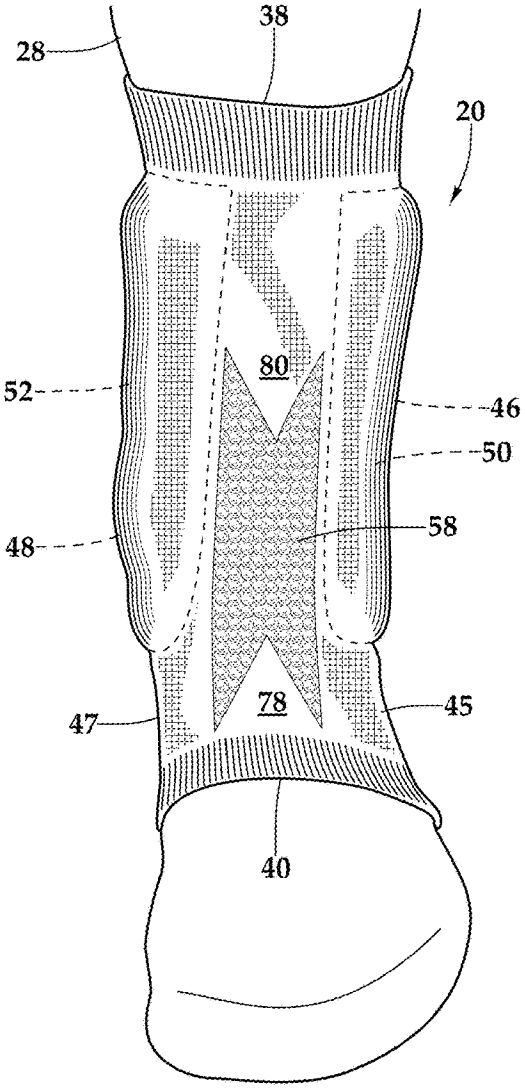
FIG. 6 is a front perspective view of the ankle protector of FIG. 5 worn on a human foot.

The wearer of an ice skate boot 24 dons the ankle protectors over the socks usually worn by inserting a foot 22 through the open upper cuff 38 and extending the toes and forward portions of the foot out the lower cuff 40. The wearer may thus freely adjust the position of the ankle protector 20 to position the first pad and the second pad about the wearer's lateral and medial malleolus, as shown in FIGS. 5 and 6. Although the front pad and rear pad are parallel strips in the as-molded shape, shown in FIG. 2, it will be observed that when engaged with the wearer's foot, the lower portion of the forward pads will bend with the foot, as shown in FIG. 5. Because the gap 66 between the forward pad and the rear pad is open downwardly, the ankle protector may be worn effectively by various types of people with various dimensions and measurements of feet, ankles, and bones. The height of the gap and the depth of the margin 68 accommodates a wide variety of size and position of malleolus of the wearer-even differences between an individual wearer's feet. In addition, the downwardly opening gaps between tabs provides an opening for wearers with navicular bones that protrude in that area, as well as for wearers with accessory navicular syndrome who have protrusions in this area. The pads take pressure off the lateral and medial malleolus as well as the navicular bone area.

The boot upper 34 has an upper margin 82 which can be a source of discomfort to a wearer, at the transition between the region where the upwardly extending upper surrounds a wearer's ankle and where it ceases to surround it. The ankle protector 20 preferably extends above the upper margin 82, as shown in FIG. 5, and the upper segments 60 of the pads shield the wearer in this region, helping to reduce pressure on the ankles in this region.

It is understood that the invention is not limited to the particular construction and arrangement of parts herein illustrated and described, but embraces all such modified forms thereof as come within the scope of the following claims.

I claim:

1. An ankle protector comprising:

a tubular body extending from an upper cuff to a lower cuff, the tubular body being resilient to receive a human foot therethrough, wherein the tubular body has a first side and an opposite second side, and wherein the first side and the second side each have an outside panel overlying an inside panel to define a first side pocket and a second side pocket, and wherein the tubular body has a heel positioned beneath the upper cuff and spaced from the lower cuff, and wherein each of the first side pocket and the second side pocket has an upper region from which extends a forward cavity and a rearwardly spaced rear cavity; and a first pad received within the first side pocket; and a second pad received within the second side pocket, wherein each of the first pad and the second pad has an upper segment with a downwardly extending forward tab and a downwardly extending rear tab spaced by a gap to be rearward of the forward tab, wherein the forward tabs are received within the forward cavities of the first side pocket and the second side pocket, and the rear tabs are received within the rear cavities of the first side pocket and the second side pocket, the tubular body configured to support the first pad and the second pad about the lateral and medial malleolus of a wearer of the ankle protector.

2. The ankle protector of claim 1 wherein the tubular body is curved to extend forwardly at the heel.

3. The ankle protector of claim 1 wherein the lower cuff is open such that the ankle protector is toeless.

4. The ankle protector of claim 1 wherein the forward cavity of the first side pocket extends downwardly below the upper cuff a greater distance than the rear cavity of the first side pocket, and wherein the forward cavity of the second side pocket extends downwardly below the upper cuff a greater distance than the rear cavity of the second side pocket.

5. The ankle protector of claim 4 wherein each of the first pad and the second pad has a lower edge which is downwardly concave and which defines the gap, the gap having an apex which is closest to the upper cuff, and wherein the forward tab extends downwardly a first distance from the apex, and the rear tab extends downwardly a second distance from the apex, and wherein the second distance is more than half the first distance and less than three quarters of the first distance.

6. The ankle protector of claim 4 wherein each of the first pad and the second pad has a lower edge which is downwardly concave and which defines the gap, the gap having an apex which is closest to the upper cuff, and wherein the forward tab extends downwardly a first distance from the apex, and the rear tab extends downwardly a second distance from the apex, and wherein the second distance is about three quarters of the first distance.

7. The ankle protector of claim 1 wherein the gap between the forward tab and the rear tab of each of the first pad and the second pad is greater than the width of the forward tab.

8. The ankle protector of claim 1 wherein each of the first pad and the second pad is comprised of a resilient closed cell foam.

9. The ankle protector of claim 1 wherein the first side of the tubular body is joined to the second side of the tubular body at a position frontward of the heel by a stretch panel.

10. The ankle protector of claim 9 further comprising perforated regions above and below the stretch panel.

11. An ankle protector comprising:

a tubular resilient woven body extending from an upper cuff to a lower cuff, wherein the tubular body has a first side and an opposite second side;

portions of the tubular body which define a first pocket on the first side and a second pocket on the opposite second side of the tubular body;

portions of the tubular body which define a heel at a rear of the tubular body;

wherein each of the first pocket and the second pocket has an upper region with a downwardly extending forward cavity separated by a gap from a downwardly extending rear cavity which is closer to the heel than the forward cavity;

a first pad received within the first pocket, the first pad having a rear tab received within the rear cavity of the first pocket and a forward tab received within the forward pocket of the first pocket;

a second pad received within the second pocket, the second pad having a rear tab received within the rear cavity of the second pocket and a forward tab received within the forward cavity of the second pocket; and wherein the tubular body is configured to support the first pad and the second pad to position the forward tab and rear tab of the first pad about the lateral malleolus of a wearer and to position the forward tab and the rear tab of the second pad about the medial malleolus of a wearer.

12. The ankle protector of claim 11 wherein the tubular body is curved to extend forwardly at the heel.

13. The ankle protector of claim 11 further comprising a lower cuff beneath the upper cuff and terminating at a lower margin of the ankle protector, such that the tubular body is open at the lower margin to receive a forward portion of a wearer's foot such that the ankle protector is toeless.

14. The ankle protector of claim 11 wherein the forward cavity of each pocket extends downwardly below the upper cuff a greater distance than the rear cavity of each of the pockets.

15. The ankle protector of claim 14 wherein each of the first pad and the second pad has a lower edge which is downwardly concave and which defines the gap, the gap having an apex which is closest to the upper cuff, and wherein the forward tab extends downwardly a first distance from the apex, and the rear tab extends downwardly a second distance from the apex, and wherein the second distance is more than half the first distance and less than three quarters of the first distance.

16. The ankle protector of claim 11 wherein the gap between the forward tab and the rear tab of each of the first pad and the second pad is at least as wide as the forward tab.

17. The ankle protector of claim 11 wherein each of the first pad and the second pad is comprised of a resilient closed cell foam.

18. The ankle protector of claim 11 wherein the first side of the tubular body is joined to the second side of the tubular body at a position frontward of the heel by a stretch panel.

19. An ankle protector comprising:

a tubular body extending downwardly from an upper cuff, the tubular body being resilient to receive a human foot therethrough, wherein the tubular body has a first side and an opposite second side, and a heel positioned below the upper cuff; and a first pad fixed to the first side;

a second pad fixed to the second side, wherein each of the first pad and the second pad has an upper segment with a downwardly extending forward tab and a downwardly extending rear tab spaced by a gap to be rearward of the forward tab, the tubular body configured to support the first pad about the lateral malleolus and the second pad about the medial malleolus of a wearer of the ankle protector; and wherein each of the first side and the second side of the tubular body has an outside panel overlying an inside panel to define a first side pocket and a second side pocket, and wherein each of the first side pocket and the second side pocket has an upper region from which extends a forward cavity and a rearwardly spaced rear cavity; and wherein the first pad is received within the first side pocket and the second pad is received within the second side pocket.

20. The ankle protector of claim 19 wherein the downwardly extending forward tab of the first pad extends parallel to the downwardly extending rear tab of the first pad.

* * * * *